United States Patent [19]

Flaceliere et al.

[11] 4,216,719

[45] Aug. 12, 1980

[54] PRINTING MACHINE PAPER DRIVE

[75] Inventors: Bernard Flacelière, Chatenay Malabry; Robert Cilesio, Clamart, both of France

[73] Assignee: Logabox, France

[21] Appl. No.: 924,333

[22] Filed: Jul. 13, 1978

[30] Foreign Application Priority Data

Jul. 13, 1977 [FR] France ..... 77 22170

[51] Int. Cl.[2] ..... B05C 17/06

[52] U.S. Cl. ..... 101/227; 226/49; 226/108; 400/605; 400/606; 400/608.2; 400/608.3; 400/621

[58] Field of Search ..... 101/226, 227, 93.07; 400/600.3, 602, 605, 606, 607.2, 608.2, 608.3, 609, 611, 613, 613.1, 621, 621.2, 630; 83/61, 63, 101, 208, 209, 360, 365, 525, 613, 697; 226/49, 108, 109, 115, 152, 190, 191, 193

[56] References Cited

U.S. PATENT DOCUMENTS

| | | | |
|---|---|---|---|
| 2,782,712 | 2/1957 | Claff et al. | 101/227 |
| 3,224,311 | 12/1965 | Wagner | 83/101 |
| 3,559,519 | 2/1971 | Westphal | 83/365 |
| 3,564,960 | 2/1971 | Foulks | 83/365 |
| 4,132,138 | 2/1979 | Miyamoto | 83/697 |

FOREIGN PATENT DOCUMENTS

| | | | |
|---|---|---|---|
| 250782 | 1/1963 | Australia | 83/101 |

*Primary Examiner*—E. H. Eickholt

*Attorney, Agent, or Firm*—William A. Drucker

[57] ABSTRACT

Device for the insertion, drive and ejection of sheets of paper in a printer, comprising at least one automatic paper insertion path and at least one manual insertion path for cards or sheets, these paths terminating in an insertion point in the impression device of the printer, characterized by means, arranged on the automatic insertion path, for effecting the insertion of a continuous paper band up to a predetermined guillotine point placed ahead of the said insertion point and means of cutting the band when a predetermined length has been engaged below the said cutting point, at the moment of its arrival at the said predetermined point.

3 Claims, 4 Drawing Figures

PRINTING MACHINE PAPER DRIVE

BACKGROUND OF THE INVENTION

In rapid printers, in particular those intended to be connected to the output of a computer, the principal vehicle for the print is usually a paper band which unrolls and is inserted in a continuous manner into the printer. This solution allows the easy storage of the paper in the feed device and lends itself to an easy realization of a rapid method of insertion. On the other hand, it is evidently unsuitable for the manual insertion of a card when a main printing operation has been terminated, because the paper band lies permanently in the printing device.

In certain printers, the principal vehicle for the print consists of sheets or cards automatically inserted. It is then possible, after the ejection of a principal card, to effect manual insertion, but one loses then the advantages, recalled above, of continuous automatic insertion.

OBJECT OF THE INVENTION

The present invention proposes to combine the advantages of the two types of paper insertion device mentioned above.

SUMMARY OF THE INVENTION

The invention consists in essence of an insertion device which comprises at least one automatic paper insertion path and at least one manual insertion path for cards or sheets, these paths terminating at an insertion point in the impression device of the printer, to provide, on the automatic insertion path, means for effecting the insertion of a continuous paper band up to a predetermined cutting point situated before the said insertion point and of means for cutting the band when a predetermined length is engaged below the said cutting point, as soon as it has arrived at the predetermined point.

According to a preferred form, the device comprises two or several automatic insertion paths having one common portion after a meeting point situated above the said predetermined cutting point and each furnished with a pair of de-clutchable driving rollers, arranged before the said meeting point, and of a second pair of driving rollers, arranged before the said meeting point, and of a second pair of driving rollers permanently engaged, placed below the said predetermined point, a device for detecting the arrival of the paper on each automatic insertion path, above the said meeting point; means for manually effecting the simultaneous engagement of the first pairs of rollers during an adjustable interval; means, actuated by the detecting devices, for inhibiting the manual control and for effecting the simultaneous engagement of the first pairs of rollers so that the paper bands traverse simultaneously the section included between the detecting devices and the said predetermined point, and means for selectively effecting the engagement of one of the first pairs of rollers after the said section has been traversed, in order to cause the paper to be advanced to the point where the second pair of rollers takes over.

Other features, as well as the advantages of the invention, will appear clearly in the description which follows.

DESCRIPTION OF THE PREFERRED EMBODIMENT

Figure 1:
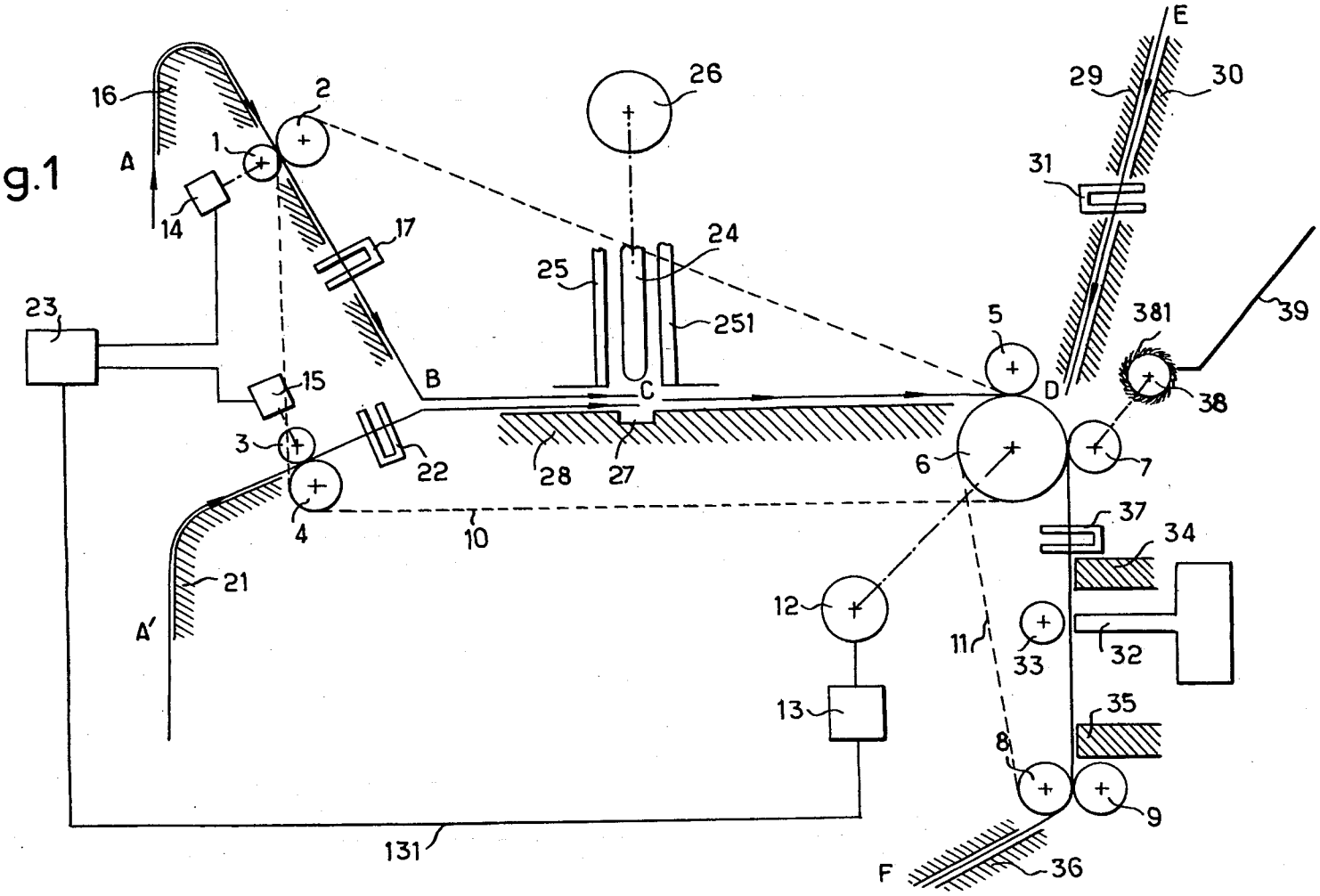
FIG. 1 is the schematic of a paper insertion device in conformity with the preferred mode of construction of the invention.

The device represented in FIG. 1 comprises two automatic insertion paths ABCD and A'BCD for continuous paper bands and a path ED for the manual insertion of cards. The paper is denoted by an arrowed line.

The paper is driven, in a manner which will be detailed below, by pairs of rollers 1–2, 3–4, 5–6 and, beyond the point of insertion D into the impression device, by rollers 6–7 and 8–9. A belt 10 connects the rollers 2–4 and 6, a belt 11 the rollers 6 and 8. Roller 6 is driven by a step-by-step motor 12 controlled by an electronic device 13 which will be described below. Rollers 8 and 9 are permanently in step as are also rollers 5–6–7. On the other hand, the simultaneous operation of rollers 1–2 is controlled by a clutch 14, while the simultaneous operation of rollers 3–4 is controlled by a clutch 15. These two clutches are controlled by the device 13. (In order to simplify the drawing, the connection between the device 13 and the clutches has not been shown).

The path AB, defined by a paper guide 16, comprises, between rollers 1–2 and the point B, a photoelectric position detector 17, comprising, in a manner already known, a photoelectric cell which receives the beam produced by a source as long as the beam is not intercepted by the paper.

In the preferred mode of construction described, the paper carries cutting lines (18, FIG. 2) prepared at regular intervals and, at one end of these lines, slots 19. The detector is arranged in such a manner that the beam ceases to be masked by the paper at the passage of each slot. The signal coming from the detector is therefore composed of pulses having a rhythm proportional to the speed of the paper drive and inversely proportional to the length of the sheets.

The first pulse is emitted, on the arrival of the edge of the paper at the detection point, by a first slot 20.

In the same way, the path A'B, defined by a paper guide 21, includes, between the rollers 3–4 and the point B, a detector 22. Detectors 17 and 22 are connected to the electronic device 13, (this connection has not been shown).

The clutches 14 and 15 are in addition controlled by means of a manual command circuit 23. 131 represents a connection between this last circuit and the electronic device 13, in order to symbolize the fact that the control of the clutches is effected from the device 13; when it is automatic, the manual command is inhibited, as will be seen in the following.

The common position BD of the two paths ABD and A'BD includes at C a paper tearing device consisting essentially of a plate 24 and two pressure plates 25 and 251 for the purpose of holding the paper during tearing. A cam not shown, driven by a motor 26, controls the movement towards the paper of the plate 24 and its return. The motor 26 is also controlled by the device 13 (the connection has not been shown).

A slot 27 is formed in the guide piece 28 which defines the path BD, so as to permit the operating edge of the plate 24 to carry out its tearing action along the cutting line of the paper.

Figure 3:
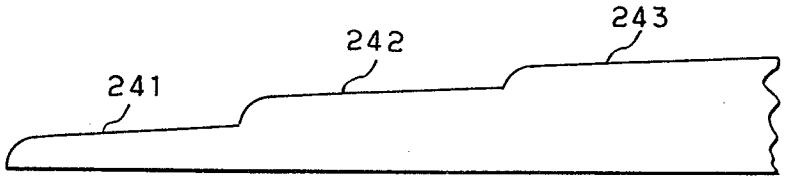
FIG. 3 represents the profile of a paper-cutting plate.

As can be seen from FIG. 3, the shape of this operating edge includes profiles which define several sections such as 241, 242, 243 (for example five). The contact of the plate with the paper only takes place at a limited number of points and the cut leaves no trace on the paper. In addition the cutting effort is small and only causes a minimum of wear.

When the actuating cam of the cutter has carried out a complete cycle, it actuates a switch (not shown) which cuts the supply to the motor 26.

The path ED, defined by two paper guide pieces 29 and 30, includes a detector 31, constructed in the same manner as those preceding and connected, in a manner not shown, to the electronic device 13.

The three paths ABD, A'BD and ED are extended by a common link DF leading to the impression device. The latter has been symbolized by an impression head 32, which is advantageously of the needle type, working against an anvil 33. It is demarcated by the paper guide pieces 34, 35 and 36. A detector 37, analogous to those preceding, is connected in a manner not shown to the electronic device 13. A small roller 38 mounted on the same spindle as the roller 7, carries on its periphery bristles or long and flexible appendages 381 so as to form a brush. A receptacle 39 is arranged in such a way as to work together with the roller 7, in a way which will be described below.

The operation of the device which has just been described is as follows:

Normally the insertion of paper makes use of one of the paths ABD or A'BD, selected by the operator.

To turn on the machine, the operator presses a manual control button which activates the circuit 23. The latter is arranged to send to the circuit 13 a signal which will cause the clutches 14 and 15 to be activated as long as the manual operating button is pressed and no electronic command is emitted from the detectors. The roller 6 being driven from the moment of switching on the machine, and driving the rollers 2 and 4, the advancement of the paper on the two tracks AB and A'B is thus effected by manual command disconnectable at any moment. This manual command is relayed by the electronic command as soon as the detectors 17 and 22 are activated. At this moment, the operator can release the manual command, the effect of which is now inhibited. The automatic command is arranged, as will be described below, so that the paper advances in accordance with a predetermined number of steps of the motor, which takes it to the point C on the two paths, after which it stops. The machine is now loaded and ready to operate. This loading operation clearly only needs to be effected when the paper feed supply has to be replenished.

Figure 2:
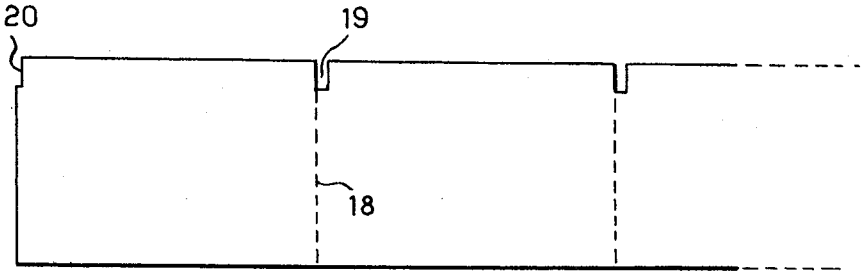
FIG. 2 represents a paper band provided with pre-incision lines and terminated with detection slots.

Supposing that the machine is now loaded, the operator, by means of a selection push-button acting on the circuit 13, selects one of the channels AB or A'B (which corresponds for example to cards of two different lengths, that is to say to different distances of tearing lines 18, FIG. 2). The effect of this selection is the operation, by means of the circuit 13, of one only of the clutches 14 and 15. On the selected path, say AB for example, the paper continues to advance beyond the point C and passes between the rollers 5 and 6. The distance between the point C and these rollers is less than the length of a card. When, in the course of this advance, a first tearing line appears under the detector 17, the circuit 13 actuates a counting device associated with the motor 12 so that the latter effects an advance of the paper by the number of steps which has been determined as already mentioned, needed to bring this tearing line to the point C, and, at the end of this number of steps, the motor 26 is started by the circuit 13, so that tearing takes place along the said tearing line.

In addition the roller 1 is declutched, so that the portion ABC of the paper stops advancing; the advance of the card CD cut in this way continuing under the action of the rollers 5–6, the end of this card (leading edge) begins to mask the detector 37; the circuit 13 effects no command in response to this first signal emitted by the detector 37. On the contrary, when the end of the card (trailing edge) unmasks the detector 37, the second signal generated by the latter is utilized by the circuit 13 in order to trigger simultaneously the reversal of the direction of motion of the motor 12 and the actuation of the impression device. This distance between the impression head 27 and the detector 37 is determined in such a way that the first line is printed in the desired position. When the impression is finished, the circuit 13 triggers the advance of the card by the predetermined number of steps so that its edge is positioned in the neighbourhood of the base of the receptacle 39 and of the roller 38. The said edge then engages with the bristles on the roller, which take it into the receptacle.

At the end of this predetermined number of steps, the circuit 13 triggers a fresh reversal of the direction of motion of the motor 12 and the machine is ready to effect a new insertion.

When the operator wishes to effect the manual insertion of a card cut in advance, he places the latter at the entrance to the path ED. When it arrives, sliding between the guides 29–30, at the position where the detector 31 emits a signal, the device 13 inhibits all control of the clutches 14 and 15 and, as a consequence, no automatic insertion is possible. Of course, manual insertion must only be made if there is no card already in the path CDF. The detector 31, which is continually tested during automatic insertion, indicates by means of a bell all wrongful manual insertion and the stoppage of the machine.

Normally the card inserted at ED is accepted on the path DF and then undergoes the same impression operations and ejection as in the case of automatic insertion.

It goes without saying that various modifications can be applied to the device which has been described and shown, without departing from the spirit of the invention. In particular, the number of automatic insertion paths can differ from two, and their relative disposition can vary. In addition, the paper band does not necessarily include slots permitting the detection of the passage of tearing lines preformed by incision.

When these slots are not offered, the electronic device 13 must nevertheless take account of the format of the paper used (that is to say of the distance between two pre-incised lines) in order to bring a pre-incised line to the point C. The information regarding this format is then, no longer perceived by the detectors 17 or 22, but introduced directly, in convenient form, in the device 13.

Furthermore, the inversion of the direction of displacement of the cards for their impression has no other interest than that of allowing a convenient arrangement of the different paths. One could imagine an arrangement in which the impression would be triggered at the moment of the first detection of a card by the detector 37 and the ejection would be effected without inversion of the direction of motion.

Figure 4:
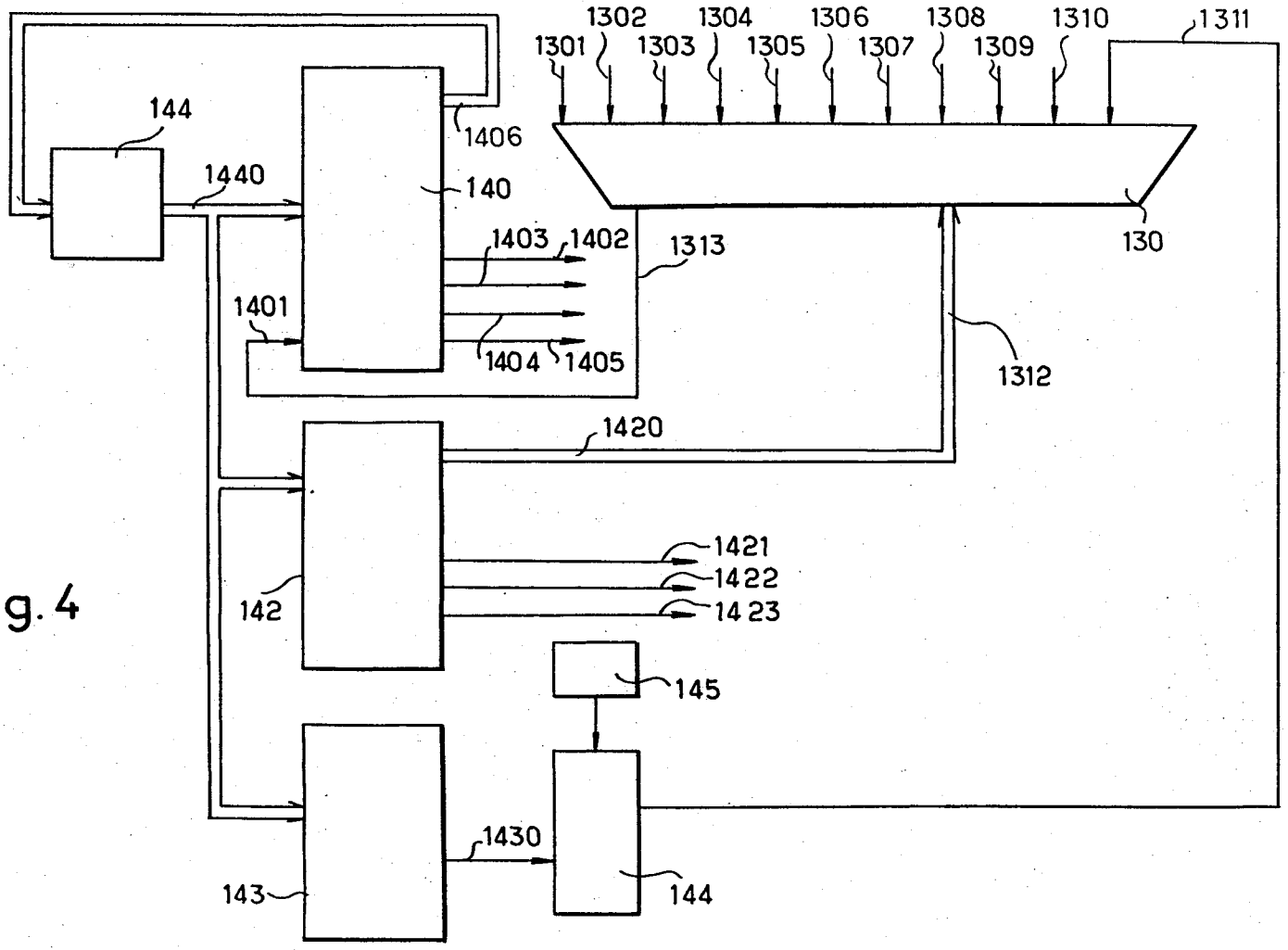
FIG. 4 is a schematic of the electronic command device for the paper drive.

The construction of all the devices mentioned above is within reach of the engineer. We will give below, however, referring to FIG. 4, a description of a preferred form of construction of the electronic device 13 of FIG. 1.

A multiplexer 130 has the following inputs:

1301 : connection with channel selection push-button,
1302 : connection with the detector 17.
1303 : connection with the detector 22,
1304 : connection with the detector 31,
1305 : connection with the detector 37,
1306 : connection with the manual circuit command push-button 23,
1307 : connection with the cut-off switch of the cutter motor,
1308, 1309 and 1310 : inputs receiving complementary advance command signals from the paper during impression.
1311 : connection with the motor (12, FIG. 1) transmitting a signal when the motor has effected a predetermined number of steps.

The multiplexer 130 has in addition as address bus-bar 1312 and an output 1313. The latter is connected to the address input 1401 of a store 140 type ROM, comprising a first page connected to an output 1406 and a second page, connected to the following outputs; 1402 : command signal of motor 12; 1403 : command signal of motor 26; 1404 : command signal of clutch 14; 1405 : command signal of clutch 15.

The output 1406 is formed from an address bus of a counter 141, the output 1440 of which is connected by an address bus, on the one hand to the store 140, on the other hand, to two other stores 142 and 143 of the same type as the store 140. One page of the store 142 has an output 1420 connected by an address bus to the input 1312 of the multiplexer while the other page has outputs 1421 (command signal of a signalling device, not shown, which operates if a pile-up of paper has been detected); 1422 (command signal for the direction of rotation of motor 12) and 1423 (validation signal for the impression).

The store 143 has an output 1430 connected to a reverse counter 144 of which the output is connected to the input 1311 of the multiplexer.

The reverse counter receives a signal coming from a clock 145 driven by the motor 12, in such a way as to furnish one pulse for each step of the motor.

On the automatic insertion of paper, with the machine switched on, the output 1402 of the store 140 is validated, so that the motor 12 starts up, driving also the rollers 6, 5, 4 and 2.

The multiplexer 130 is addressed by the store 142 so as to test the logic level at the input 1306. When the operator presses the manual command push-button, the test is positive, that is to say a logic level 1 is applied to the input 1401. The output 1406 of the store 140 is then stepped, and steps the counter 144, in such a manner that the addresses of inputs 1306, 1302 and 1305 of the multiplexer are read in the store 142. At the same time, the output signals from 1404 and 1405 are supplied by the store 140 and control the clutches 14 and 15.

The test of the inputs 1302 and 1303 is effected at the same time as that of the input 1306. As soon as one of the inputs 1302 or 1303 is at level 1, the testing of input 1306 ceases and a predetermined number of advance steps of the motor 12 is triggered. For this purpose, the said number written in the store 42, is inserted into the reverse counter 144. At each step of the motor 12, the clock 145 steps this reverse counter back by one unit. When the contents of the reverse counter are zero, a signal is transmitted to the input 1311 of the multiplexer, which then addresses the stores so that the sequence of operations described above takes place. When the operator presses the push-button for the selection of one of the channels AB or A'B (FIG. 1) the input 1301 is tested and one of the clutches 14 or 15 is actuated by the signal from either the output 1404 or the output 1405. In the mode of construction described above the advance of the paper corresponding to the selected channel beyond the point C is commanded by testing the input 1302 or 1303 of the multiplexer. From the moment when a signal, present at this input, indicates that the first pre-incised line mentioned above has been detected, an advance of a predetermined number of steps, stored in 143, is commanded in the way already described, by registering in the reverse counter 144 and counting down the pulses supplied by the clock 145. In the variant in which the paper does not contain slots for detection, the information about the format is introduced in the form of a constant in the store 143 and the advance which brings the first pre-incised line to the point C is obtained by the registration of this constant in the reverse counter 144.

In the two cases, when the input 1311 is validated afresh, the signal supplied at the output of the multiplexer addresses the store 140 to cause it to emit, at its output 1403, a command to start the cutter motor 26 and on the output 1404 or 1405, a command to stop the motor of the clutches 14 or 15 which was in operation, then after cutting of the sheet, a command for the stopping of the latter.

When the sheet which has been cut arrives at the detector 37, the test of input 1305 of the multiplexer is positive with the result that the store 149 is addressed in such a way that the output 1422 commands the reversal of the direction of motion of the motor 12. The output 1423 thus supplies, to the electronic part of the printer, classically associated with the impression devices, a validation signal for printing. After impression, the paper undergoes an advance of a predetermined number of steps, registered in 143 in the form of a constant and inserted in the reverse counter 144 in the way which has already been described. The output 1422 thus supplies a new signal for reversal of the direction of motion of the motor 12.

We claim :

1. A device for insertion, drive and ejection of sheets of paper in a printer, comprising means defining plural automatic paper insertion paths and at least one manual insertion path for cards or sheets, said printer having an impression unit, said paths energing into a single paper feed path at an insertion point in the impression unit of the printer, said device further comprising means, arranged on each of the automatic insertion paths, for effecting the insertion of a continuous band of paper up to a predetermined cutting point common to each automatic insertion path, and located above the said insertion point and means for cutting the band when a predetermined length has been engaged below the said cutting point, on its arrival at the said cutting point, the automatic insertion paths having a common portion from a meeting point situated above the said predetermined cutting point and each automatic insertion path including a first pair of declutchable driving rollers placed above the said meeting point; a second pair of permanently engaged driving rollers being placed below the said cutting point; the device further comprising means for detecting the arrival of the paper on each automatic insertion path, above the said meeting point; means for effecting manual control of the simultaneous engagement of the first pairs of rollers during a controllable interval; means, actuated by the said detecting means, for inhibiting the said manual control and for automatically controlling the simultaneous engagement of the first pairs or rollers so that the bands of paper traverse simultaneously the portion of path included between the detecting means and the said cutting point, and means for selectively controlling the engagement of one of the first pairs of rollers after the said portion of path has been traversed, so as to advance the paper to the second pair of drive rollers.

2. A device according to claim 1, wherein each continuous paper band carries pre-incised tearing lines defining the said predetermined length, the said means for selectively controlling the engagement of one of the first pairs of rollers being adjusted so as to bring a selected cutting line of the paper band to the said predetermined point, and to actuate the cutting means, at the moment when the said cutting line has reached the said predetermined point.

3. A device according to claim 2, wherein the paper band carries, on the said cutting lines, reference marks designed to line up with the detecting means, the said means for selectively controlling the engagement of one of the pairs of rollers being arranged for advancing the selected paper band by a length which corresponds to the portion of path included between the detecting means and the said predetermined point, from the moment when the detecting means have registered the first cutting line which appears after the said paper band has reached the said predetermined point.

* * * * *